US007785145B2

(12) United States Patent
Menez

(10) Patent No.: US 7,785,145 B2
(45) Date of Patent: Aug. 31, 2010

(54) ELECTRICAL CONNECTOR FOR ATTENUATING VIBRATIONS, IN PARTICULAR FOR THE INJECTOR OF A MOTOR VEHICLE ENGINE

(75) Inventor: Frédéric Menez, Hermeray (FR)

(73) Assignee: FCI, Versailles (FR)

( * ) Notice: Subject to any disclaimer, the term of this patent is extended or adjusted under 35 U.S.C. 154(b) by 8 days.

(21) Appl. No.: 11/711,934

(22) Filed: Feb. 27, 2007

(65) Prior Publication Data

US 2008/0102683 A1 May 1, 2008

Related U.S. Application Data

(63) Continuation of application No. PCT/EP2005/009320, filed on Aug. 30, 2005.

(30) Foreign Application Priority Data

Aug. 30, 2004 (FR) ..... 04 09195

(51) Int. Cl.
*H01R 13/40* (2006.01)

(52) U.S. Cl. ..... 439/587; 439/271

(58) Field of Classification Search ..... 439/358, 439/352, 595, 275, 587–589, 274
See application file for complete search history.

(56) References Cited

U.S. PATENT DOCUMENTS

| | | | | |
|---|---|---|---|---|
| 5,336,101 | A | 8/1994 | Kasugai et al. | 439/272 |
| 5,520,548 | A | 5/1996 | Hotea et al. | 439/358 |
| 6,419,515 | B1 * | 7/2002 | Okayasu | 439/358 |
| 6,514,098 | B2 * | 2/2003 | Marpoe et al. | 439/352 |
| 6,688,907 | B2 * | 2/2004 | Yamaoka et al. | 439/357 |
| 6,896,538 | B2 * | 5/2005 | Grubbs | 439/352 |
| 7,114,983 | B2 * | 10/2006 | Fukatsu et al. | 439/358 |
| 7,252,530 | B2 * | 8/2007 | Shamoto | 439/352 |
| 7,481,674 | B2 * | 1/2009 | Murakami et al. | 439/587 |

FOREIGN PATENT DOCUMENTS

EP 1 091 453 A2 4/2001

* cited by examiner

*Primary Examiner*—Briggitte R Hammond
(74) *Attorney, Agent, or Firm*—Harrington & Smith

(57) ABSTRACT

The inventive connector includes a locking device for elastical interlocking which is provided with an axial stop surface forming jointly with the associate stop surface of the complementary locking device of a counterpart an mutual rest preventing the disconnection of the connector and the counterpart. Said connector includes an elastic vibration attenuating member arranged in such a way that it produces the mutual elastic rest force of the stop surfaces when the connector and the counterpart thereof are coupled. The invention can be used for connecting the injector of a motor vehicle internal combustion engine.

16 Claims, 6 Drawing Sheets

ELECTRICAL CONNECTOR FOR ATTENUATING VIBRATIONS, IN PARTICULAR FOR THE INJECTOR OF A MOTOR VEHICLE ENGINE

CROSS REFERENCE TO RELATED APPLICATION

This application is a continuation of International Patent Application No. PCT/EP2005/009320 filed Aug. 30, 2005.

The present invention concerns an electrical connector designed to be coupled with a connector counterpart by elastic interlocking along a coupling direction, and comprising for this purpose a device that locks by elastic interlocking and has an axial stop surface provided in order to create, together with a stop surface associated with a complementary locking device of the counterpart, a mutual support opposing a disconnection of the connector and the counterpart.

In certain applications in severe environments, as is the case particularly for connection technology in the engine compartment of motor vehicles, the quality of the electrical contacts can be rapidly degraded and malfunctioning can be generated.

In the particular example of a connection device for an internal combustion engine injector, the connection base made in one piece with the engine is subjected to high levels of vibration and is also subjected to temperature levels that are also very high.

With connectors and bases of the known type, locking devices that offer a great simplicity of mounting of the connector onto the base, however, undergo significant wear and a loss of efficacy over the lifetime of the vehicle, due to these severe operating conditions. The progressive wear of the locking devices leads to an increase of the axial play between the connector and the base, so that friction is produced between the complementary contacts of the base and the connector.

Thus the functioning of known connection devices of the type disclosed above is affected in an amplified manner over time, since the appearance of play generates wear, which itself increases the play, etc.

The object of the invention is to resolve this problem without increasing the complexity of the locking devices of the connector and the base, and without increasing the difficulty of positioning the connector on the base.

For this purpose, the subject of the invention is an electrical connector of the above-mentioned type, characterized in that it comprises an elastic component for attenuating vibrations, arranged in such a way as to create an elastic force of mutual support for the stop surfaces, when the connector and its counterpart are coupled.

According to other characteristics of the invention:

- the electrical connector comprises a peripheral seal, provided in order to assure tightness between the connector and its counterpart when they are coupled, and the elastic attenuating component makes up part of said seal;
- the peripheral seal is a lip seal; and
- the seal is made in one piece, particularly of an elastomer.

According to a first embodiment of the invention, the electrical connector comprises a casing on which is provided the locking device, and a contact-bearing module, which is mounted inside the casing by interlocking with the possibility of axial play, and the elastic attenuating component is arranged so as to be compressed axially between the module and the casing, when the module is mounted in the casing, with the effect of locking the connector onto the counterpart.

Preferably, the peripheral seal is mounted on said contact-bearing module.

According to a second embodiment of the invention, the connector comprises a contact-receiving casing, on which is provided the locking device, and the elastic component is provided so as to be compressed axially between the casing and the counterpart, with the effect of locking the connector onto the counterpart.

Preferably, the peripheral seal is mounted on said casing.

The invention also pertains to a device for electrical connection comprising an electrical connector such as defined above, and a base forming a counterpart for said connector, said base being a base of a motor vehicle part.

In particular, the base can be a base of an internal combustion engine part of a motor vehicle, particularly a base for the fuel injector.

Particular embodiments of the invention will now be described in more detail, in reference to the attached drawings, in which.

In FIGS. 1 to 6, we have shown an electrical connector conforming to a first embodiment of the invention.

In the example shown, this connector 1 is of the two-way type for an injector of the internal combustion engine of a motor vehicle, provided to be coupled with a base 3 (FIGS. 5 and 6) forming a counterpart for the connector.

In all the Figures, we have introduced an X axis corresponding to the direction of coupling and oriented in the direction of engagement of the connector towards the base. The terms "front" and "back" used in the following will be understood with regard to this orientation, supposing that the connector is engaged onto the base by a movement from back to front.

The terms "axial" and "transverse" will also be understood with regard to this X axis.

In the first embodiment of the invention represented in FIGS. 1 to 6, connector 1 comprises a contact-bearing module 5 and a casing 7, both of insulating material.

Figure 3:
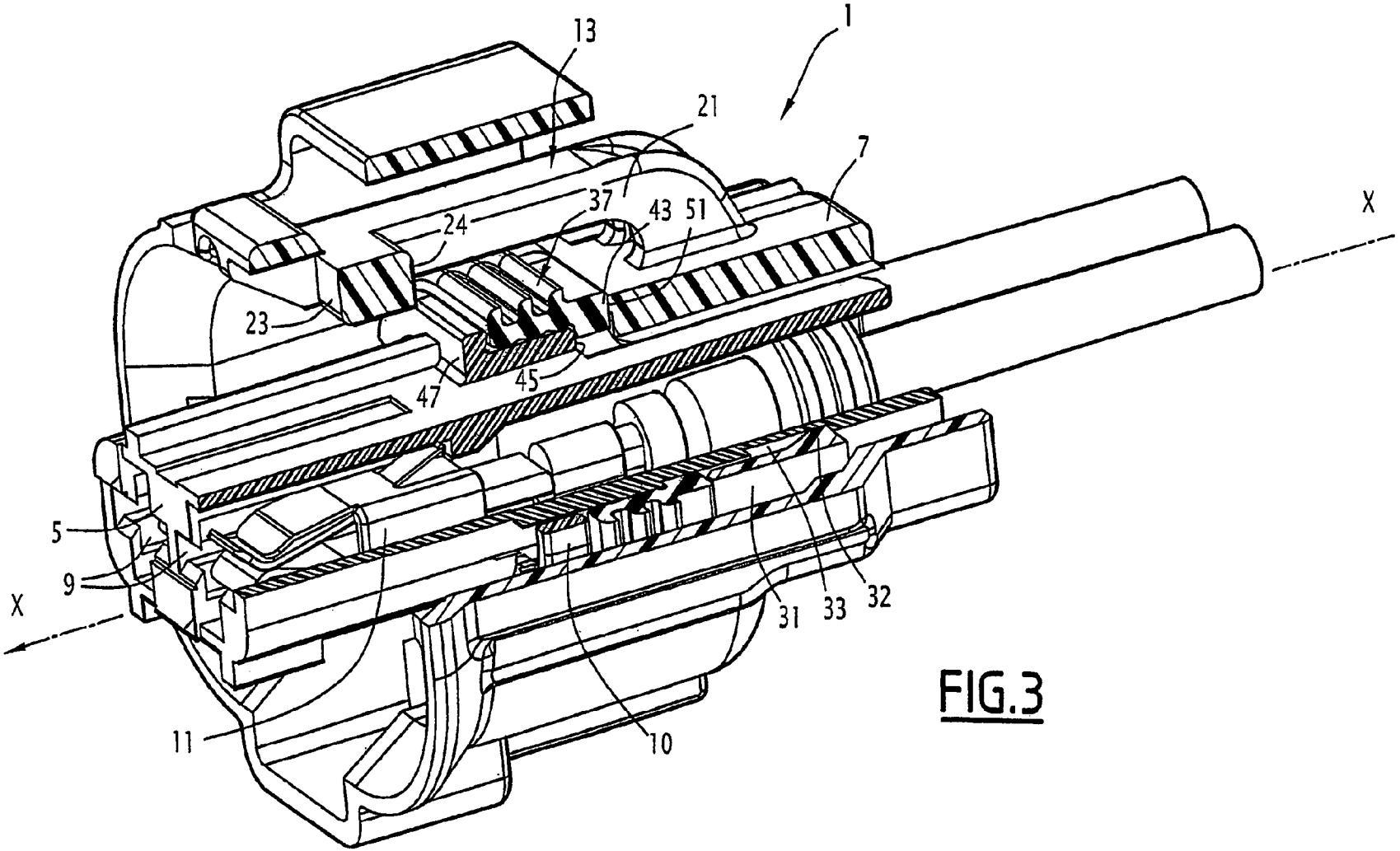
FIG. 3 is a perspective view of the connector of FIGS. 1 and 2, partially torn away, the module being mounted in the casing, and containing contacts connected to respective electric cables.
Figure 5:
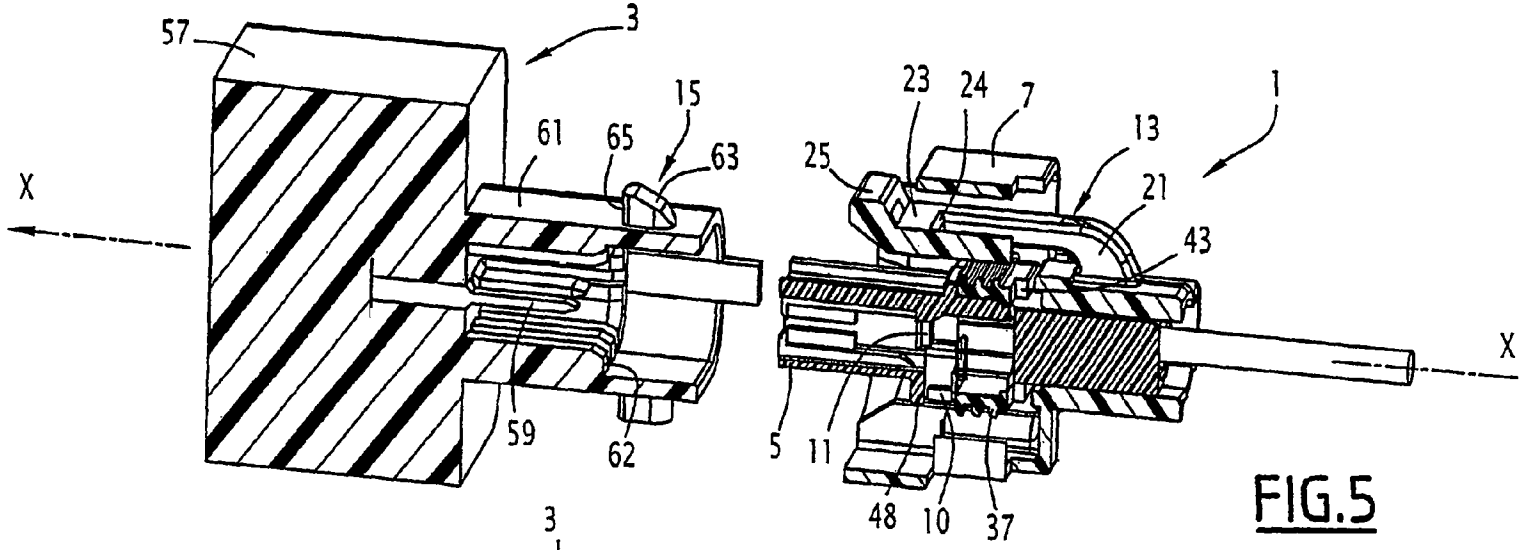
FIG. 5 is a perspective view, cut in a median axial plane, of the connector of FIGS. 3 and 4, and of the base forming the counterpart, in a ready-to-engage position.
Figure 6:
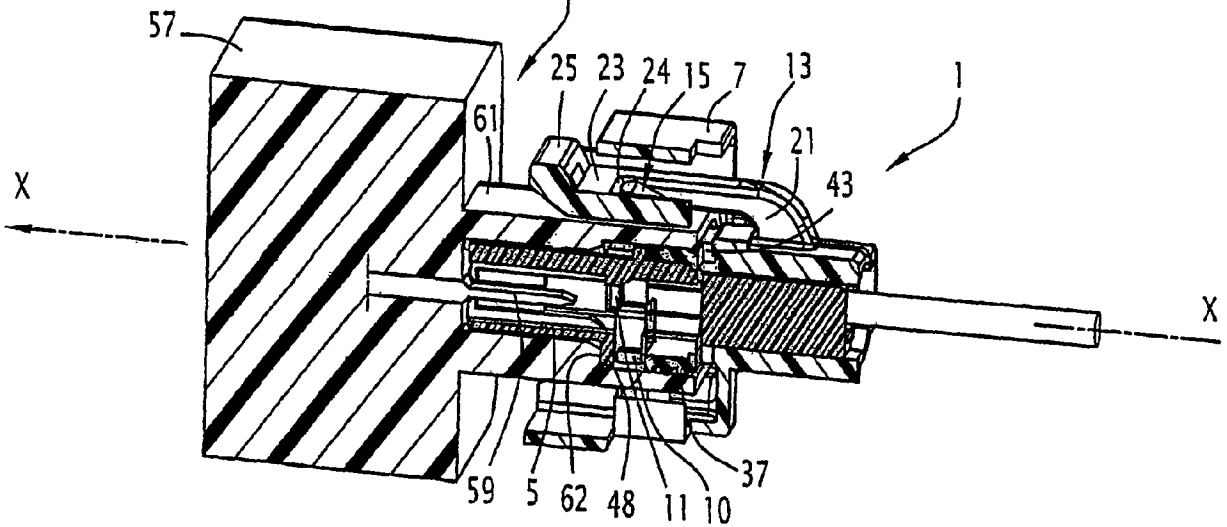
FIG. 6 is a view analogous to FIG. 5, in the position of complete engagement of the connector and the base.

Module 5 is formed with two axial sockets 9, in which respective contacts 11 are received and fastened (only shown in FIGS. 3, 5, and 6).

Module 5 comprises a secondary locking key 10, mounted in a transversely mobile manner relative to sockets 9, between a standby position in which it permits complete insertion of the contacts in the sockets, and a service position in which it locks the contacts thus engaged in the sockets, opposing a force that would pull them out. Secondary locking key 10 extends generally along a transverse plane, i.e., orthogonal relative to the X axis.

Casing 7 is designed as an envelope in which module 5 can be arranged and fixed, and has a locking device 13, provided to assure, together with a complementary device 15 of base 3, the detachable attachment of connector 1 onto base 3 in the coupled position.

Components 13, 15 for mutual locking of the connector and the base 3 are means for elastic interlocking functioning axially, i.e., along coupling direction X.

In the example shown, locking device 13 has two essentially parallel axial elastic arms 21, formed projecting and overhanging from a peripheral wall of casing 7. It also comprises a bridge 23 connecting the two axial arms 21 from the side of their free end situated in front and having a transverse stop surface 24 for the rear side. Locking device 13 also comprises a maneuvering button 25, formed at its free end.

On the inside, casing 7 has elastic interlocking components 31 (FIG. 2), in the form of lateral flexible tabs.

Figure 1:
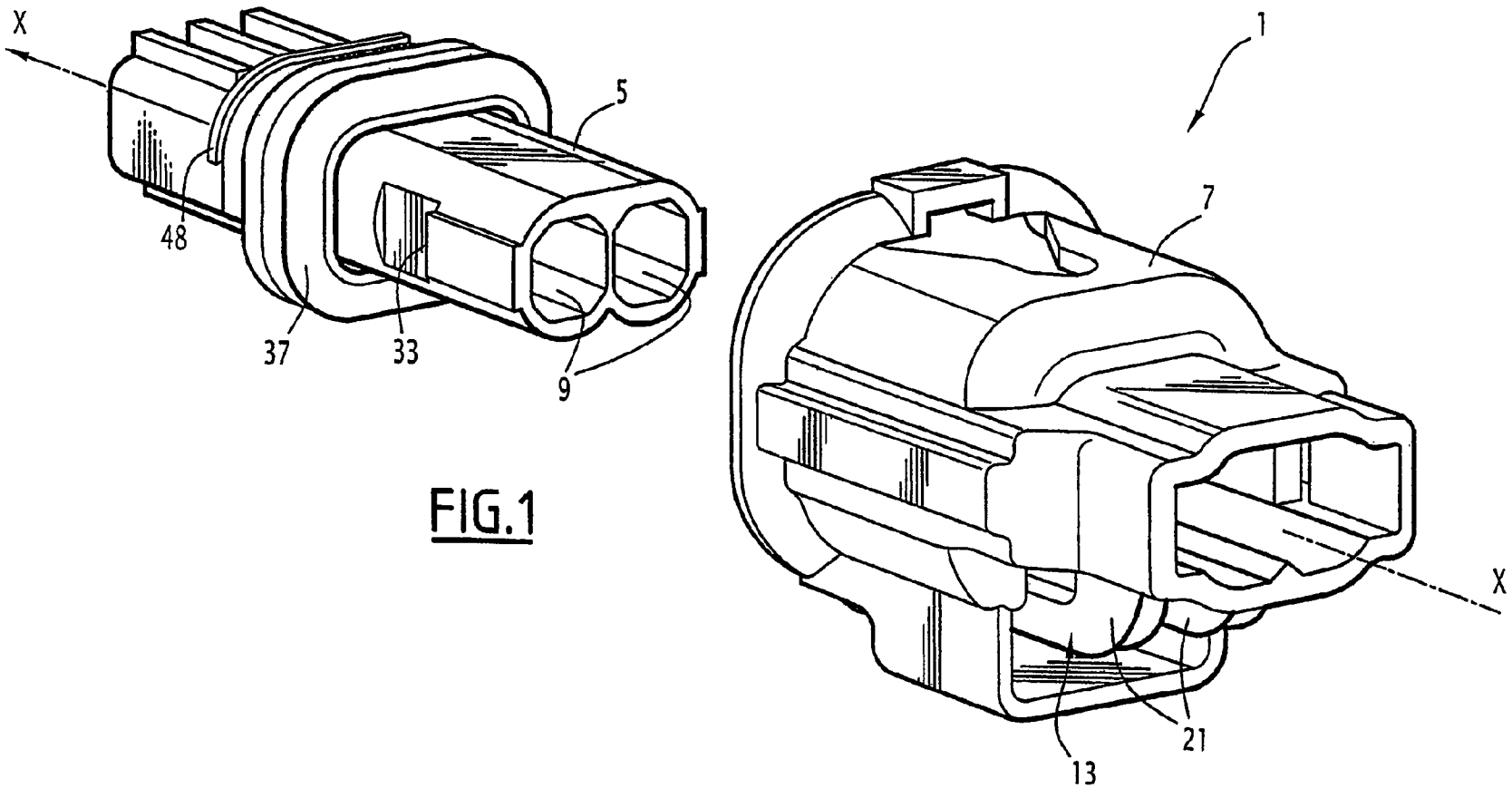
FIG. 1 is a partial perspective view of an electrical connector according to a first embodiment of the invention, the contact-bearing module being separated from the casing.

Each elastic tab 31 has a tooth 32 formed at its free back end, which is provided to be engaged in a corresponding notch 33 formed laterally on module 5 (FIG. 1). Tooth 32 and notch 33 define together, when module 5 is elastically interlocked in casing 7, an axial support opposing removal, from back to front, of module 5 relative to casing 7. It will be noted that interlocking components 31 and notches 33 are designed to allow a relative axial play from front to back of module 5 relative to casing 7, from the support position of the tooth against the shoulder formed by notch 33, as is shown in FIG. 3.

Moreover, connector 1 comprises a peripheral lip seal 37 mounted by fitting onto module 5, and provided to assure an interfacial tightness between base 3 and connector 1.

Figure 2:
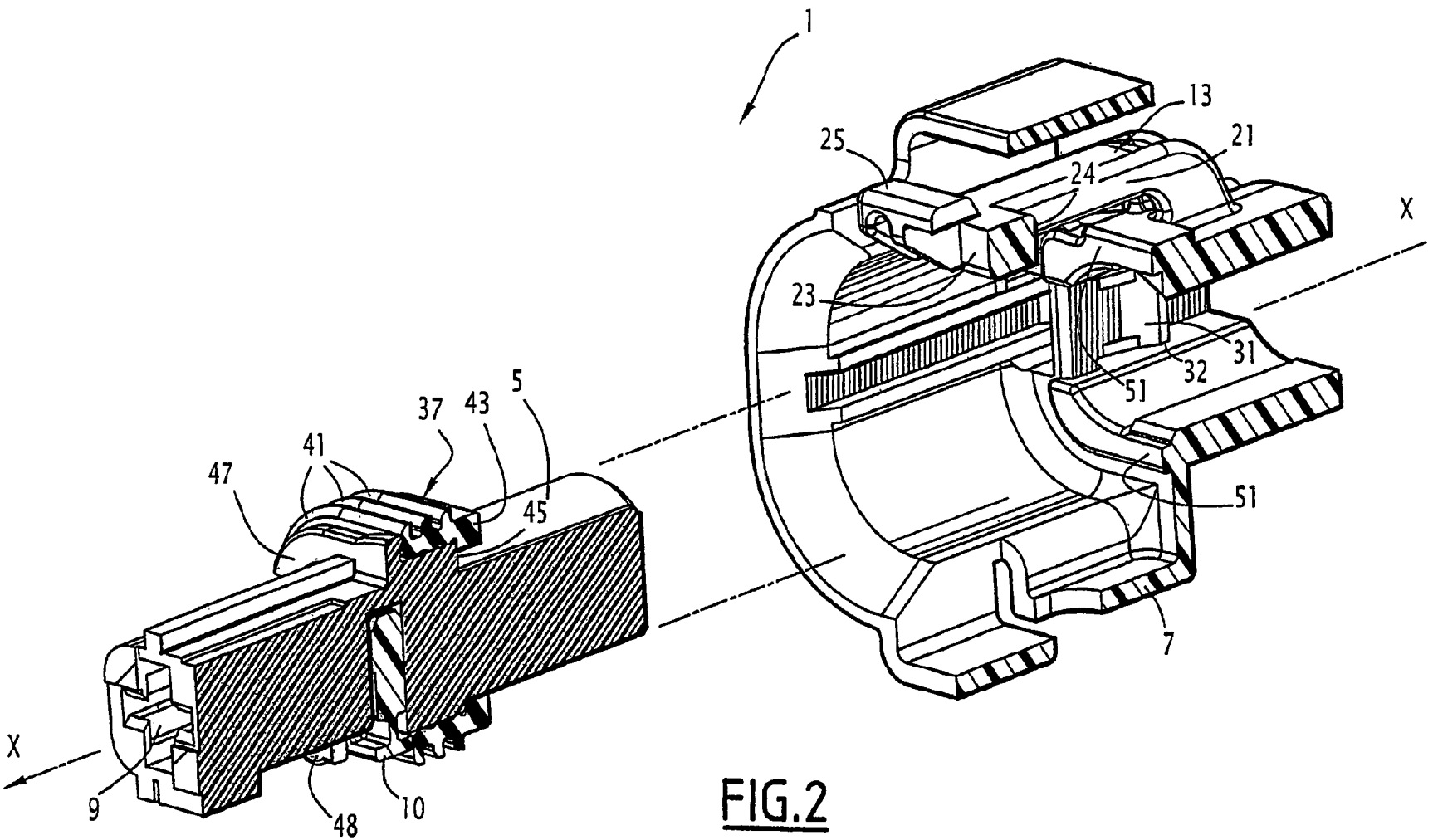
FIG. 2 is a view analogous to FIG. 1, cut in a median axial plane, and in a different direction from that of FIG. 1.
Figure 4:
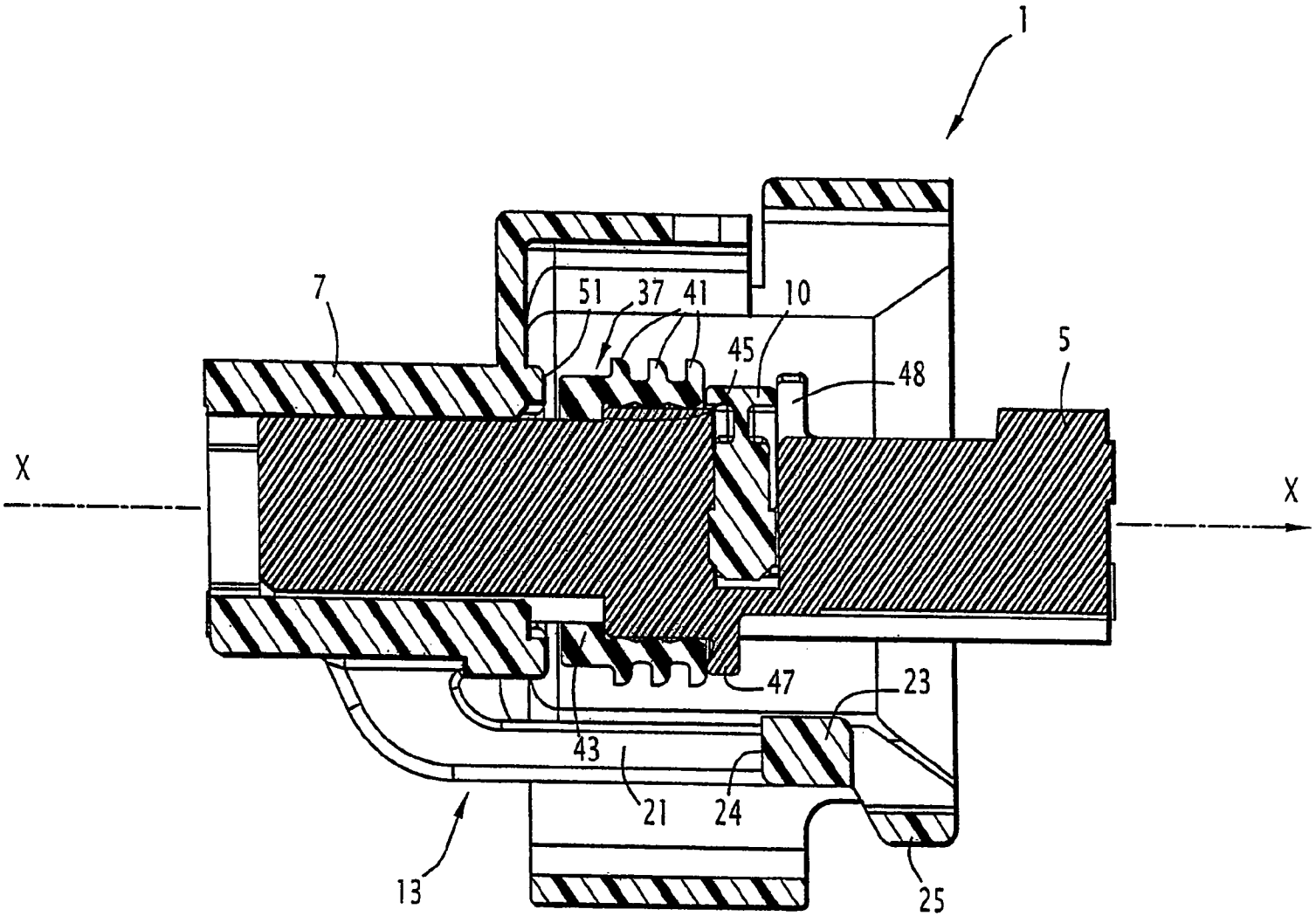
FIG. 4 is a sectional view, in a median axial plane, of the connector of FIG. 3.

As is particularly visible in FIGS. 2 to 4, seal 37 has the general shape of a sleeve provided with a series of flanges 41 in radial projection defining lips (three in the example shown), and has, on the front side, a rim 43 forming a shoulder.

In a corresponding manner, module 5 has a first peripheral back rim 45 forming a shoulder for rim 43 and, over a part of its periphery, successively from back to front from the first rim, a second rim 47 and a third rim 48.

When module 5 is in its interlocked position in casing 7 (see FIG. 4, in particular), rim 43 of the seal is supported on peripheral rim 45 of module 5.

Seal 37 is then positioned without contact relative to a bottom surface 51 of casing 7, which is inscribed in an annular surface, and situated in the axial extension of the seal.

It will be noted that the secondary locking key 10 is arranged at the front of the support surface of rim 47, provided to receive and support seal 37. Thus, the seal does not come into contact with said key 10, and it does not hinder the movement of this key.

By referring to FIGS. 5 and 6, we will now succinctly describe base 3, which was shown schematically in these Figures.

Base 3 comprises an insulating casing 57 in which a series of contacts 59 are arranged, terminal pins here, complementary to contacts 11 seated in module 5. Casing 57 is formed with a skirt 61 inside of which terminals 59 project axially.

The inside of skirt 61 is formed with a peripheral shoulder 62, which constitutes an engagement stop for rim 48 of module 5.

Locking device 15 complementary to locking device 13 of casing 7, is formed radially projecting from skirt 61. It is present as a tooth piece endowed with an inclined ramp 63 turned toward the back, and with a back surface 65 which is transverse relative to the X coupling axis, this stop surface 65 facing the front.

As is visible more particularly in FIG. 6, when connector 1 and base 3 are in mutual coupling position, the interfacial tightness between module 5 and casing 57 is created by contacting lips 41 with the inner surface of skirt 61.

By referring again to FIGS. 5 and 6, one understands that the locking of connector 1 onto base 3 during their mutual coupling is produced in the manner explained below, module 5 being fixed inside casing 7 beforehand, as shown in FIGS. 3 and 4.

When module 5 is axially engaged in skirt 61, bridge 23 of locking device 13 comes to be supported on inclined ramp 63 of tooth piece 15.

When this movement of axial engagement is continued, arms 21 are deformed by bending and move away from the X axis, bridge 23 following inclined face 63, until tooth piece 15 is engaged between arms 21 due to their elastic recoil to their rest position.

Stop surface 24 of bridge 23 then comes to be supported on stop surface 65 of tooth piece 15, so as to oppose the removal of connector 1.

During this phase of engagement, before elastic recoil of arms 21, front rim 48 of module 5 comes to be stopped on inner shoulder 62 of skirt 61, so that the rest of the engagement movement of connector 1 onto base 3 is accompanied by a relative axial movement of casing 7 relative to module 5. This relative movement is permitted by the axial play of tooth 32 in notch 33. Thus, surface 51 of the bottom of casing 7 comes into contact with the rear face of seal 37, by compressing rim 43 between this annular face 51 and peripheral rim 45 of the module.

When arms 21 elastically return to their rest position, at the end of the engagement phase, rim 43 of seal 37 elastically pulls stop surfaces 24, 65 of locking devices 13, 15 into mutual support, rim 43 of the seal remaining compressed.

When connector 1 and base 3 are thus coupled and in service position, rim 43 of the seal makes use of the elastic vibration attenuating component which limits the relative movements of stop surfaces 24, 65 of the locking devices.

Thus, as long as the acceleration forces caused by vibrations remain inferior to the support forces between stop surfaces 24, 65 and surfaces 48, 62, there is no longer any relative movement inducing wear of the parts, and in the case where they may exceed the support forces, said movements are of lesser amplitude.

It will also be noted that rim 43 is undercut over a part of the seal periphery (see FIGS. 5 and 6) so that the axial compression of seal 37, during coupling, is created solely over a part of the periphery of the seal. This characteristic permits adjusting the elastic recoil force applied to the locking devices, and so that the coupling of connector 1 onto base 3 does not require an excessive coupling force.

The one-piece (or single block) design of the seal and the elastic component has the advantage of low cost of manufacture and mounting.

However, the invention can also be envisioned, as will be seen in the following, with an elastic component separate from the seal. In such a case, one can possibly choose different materials to create the elastic component, on the one hand, and the seal, on the other hand. For example, an elastomer having specific attenuating properties can be chosen to make up the elastic component. As a variant, this elastic component could be made up of a metal spring.

Figure 7:
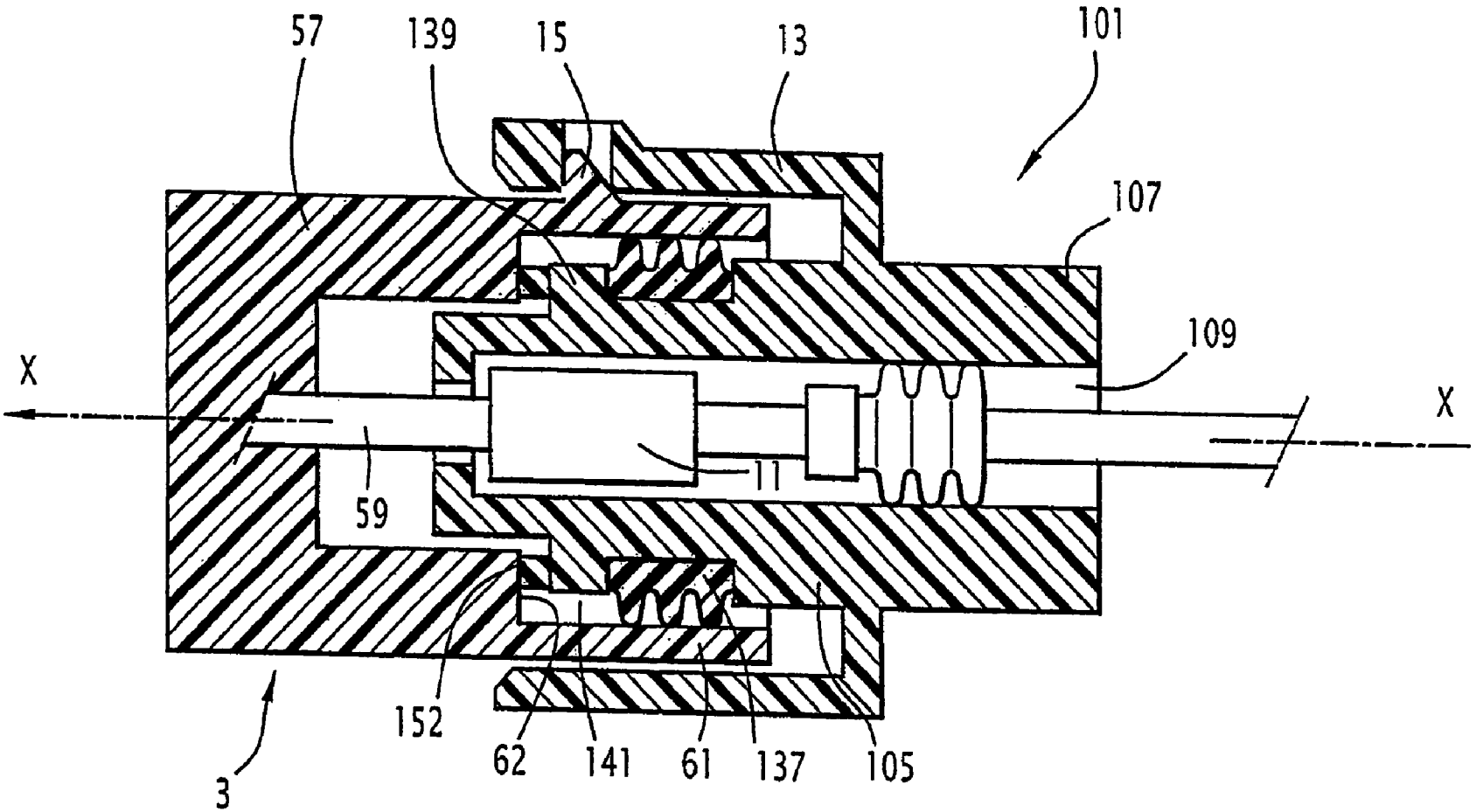
FIG. 7 is a schematic view, in section, in a median axial plane, of a connector according to a second embodiment of the invention and the base, in a position of mutual engagement.

In FIG. 7, a connection device conforming to a second embodiment of the invention is shown schematically, in which base 3 is identical to the base shown in FIGS. 5 and 6. In this embodiment, complementary connector 101 differs from connector 1 essentially in that it does not have a contact-bearing module, and in that the elastic component is a separate piece from the seal, as mentioned above.

Sockets 109 for receiving contacts 11 are formed in insulating casing 107. This casing is provided with a locking device 13, which can be identical to that described previously and shown in FIGS. 1 to 6.

Casing 107 thus comprises a body 105 analogous to module 5, and on the peripheral surface of which is fitted lip seal 137. A shoulder 139, formed projecting radially from the outer surface of body 105, receives seal 137 in axial support, so as to hold the seal in its functioning position on body 105.

The connector also comprises an annular elastic component 152, arranged on a periphery of casing 107, in the axial extension of the seal, and supported on the opposite side of shoulder 139. In the example shown, elastic component 152 is made of the same elastomer material as lip seal 137.

Elastic component 152 is analogous to rim 43 in the first embodiment described, in that it constitutes the elastic attenuating component, which is compressed during the coupling of connector 101 onto base 3, and which elastically pulls the stop surfaces of complementary locking devices 13, 15 into mutual support at the end of the engagement phase.

As is visible in FIG. 7, elastic component 152 is compressed between inner shoulder 62 of the base and shoulder 139.

By minor modifications of existing connectors, and, in particular, by minor modifications of peripheral lip seals, the invention that has just been described permits reducing the effects of vibration on the wear of the locking devices, and incidentally, improving the contact reliability of the connection device.

The advantage obtained is particularly important in the case of connectors for fuel injection systems for motor vehicle engines, given the high level of vibrations, temperature and mechanical stresses.

The invention claimed is:

1. An electrical connector provided to be coupled with a connector counterpart by elastic interlocking along a coupling direction (X), and comprising for this purpose a device that locks by elastic interlocking and has an axial stop surface provided to create a mutual support, together with an associated stop surface of a complementary locking device of the counterpart, opposing a disconnection of the connector and the counterpart, said connector also comprising an elastic component and a peripheral seal, wherein the elastic component is arranged in such a way as to create an elastic force of mutual support of the stop surfaces, when the connector and the counterpart are coupled, characterized in that the connector comprises a casing on which is provided a locking device, and a contact-bearing module which is mounted inside the casing by an interlocking connection of the contact-bearing module with the casing, wherein the elastic component contacts a first portion of the contact-bearing module, wherein the interlocking connection is sized and shaped to allow relative axial play between the contact-bearing module and the casing, and in that the elastic component is compressed axially between the module and the casing, when the module is mounted in the casing, with the effect of locking the connector onto the counterpart, and wherein the peripheral seal is fitted onto a second different portion of the contact-bearing module.

2. The electrical connector according to claim 1, further characterized in that the peripheral seal is provided so as to assure tightness between the connector and the counterpart when they are coupled, and in that the elastic component is part of said seal.

3. The electrical connector according to claim 2, further characterized in that the peripheral seal is a lip seal.

4. The electrical connector according to claim 2, further characterized in that the seal is made in a single piece, particularly of an elastomer.

5. The electrical connector according to claim 1, further characterized in that the peripheral seal is mounted on said contact-bearing module.

6. An electrical connection device comprising an electrical connector according to claim 1, and a base forming the counterpart of said connector, said base being a base of a motor vehicle part.

7. The electrical connection device according to claim 6, further characterized in that said base is a base of an internal combustion engine part of a motor vehicle, in particular, a base of the fuel injector.

8. An electrical connector configured to be coupled with a connector counterpart, the electrical connector comprising:

a casing comprising a locking device having a first stop surface, wherein the first stop surface is sized and shaped to engage a second stop surface of a complementary locking device of the connector counterpart for opposing disconnection of the connector and the connector counterpart, wherein the locking device is sized and shaped to lock with the complementary locking device by elastic interlocking;

a contact-bearing module movably mounted to the casing by an interlocking connection, wherein the interlocking connection is sized and shaped to allow relative axial movement between the contact-bearing module and the casing;

an elastic component located between portions of the casing and the module such that, when the connector is mounted to the connector counterpart, the module is located to be moved relative to the casing by contact of the module with the connector counterpart, and the elastic component is compressed axially between the module and the casing to thereby bias the first stop surface against the second stop surface and reduce vibrations between the connector and the connector counterpart, and wherein the elastic component contacts a first surface of the contact bearing-module; and a peripheral seal fitted onto a second different surface of the contact-bearing module.

9. The electrical connector according to claim 1 wherein the elastic component and the peripheral seal are integrally formed as a one piece member.

10. The electrical connector according to claim 1 wherein the elastic component and the peripheral seal comprise separate members.

11. The electrical connector according to claim 1 wherein the elastic component comprises a rim forming a shoulder.

12. The electrical connector according to claim 11 wherein the first portion of the contact-bearing module comprises a peripheral rim, and wherein the rim of the elastic component contacts the peripheral rim of the contact-bearing module.

13. The electrical connector according to claim 1 wherein the first portion of the contact-bearing module is spaced from the second portion of the contact-bearing module.

14. The electrical connector according to claim 8 wherein the elastic component and the peripheral seal are integrally formed as a one piece member.

15. The electrical connector according to claim 8 wherein the elastic component and the peripheral seal comprise separate members.

16. The electrical connector according to claim 8 wherein the first surface of the contact-bearing module is spaced from the second surface of the contact-bearing module.

* * * * *